US007011085B1

(12) United States Patent
Lochotzki

(10) Patent No.: US 7,011,085 B1
(45) Date of Patent: Mar. 14, 2006

(54) BRICK CLAMP FOR MASONRY WORK

(76) Inventor: Matthew Lochotzki, 255 W. CR 73, Fremont, OH (US) 43420

( * ) Notice: Subject to any disclaimer, the term of this patent is extended or adjusted under 35 U.S.C. 154(b) by 277 days.

(21) Appl. No.: 10/438,564

(22) Filed: May 15, 2003

(51) Int. Cl.
*B28D 1/32* (2006.01)

(52) U.S. Cl. ..... 125/23.02

(58) Field of Classification Search ..... 125/23.02, 125/23.01; 83/886; 269/43, 289 R, 307
See application file for complete search history.

(56) References Cited

U.S. PATENT DOCUMENTS

| | | | | |
|---|---|---|---|---|
| 3,060,917 | A | 10/1962 | Dickey | |
| 3,090,615 | A | 5/1963 | May | |
| 3,141,453 | A | 7/1964 | Dickey | |
| 3,463,137 | A | 8/1969 | Hare | |
| 4,068,648 | A | 1/1978 | Erdman | |
| 4,211,130 | A | 7/1980 | Buckner et al. | |
| 4,315,494 | A | 2/1982 | DiPlacido | |
| 4,924,843 | A | 5/1990 | Waren | |
| 5,007,317 | A | 4/1991 | Jenkner | |
| 5,127,391 | A | 7/1992 | O'Keefe | |
| 5,169,045 | A * | 12/1992 | Liu | 225/96.5 |
| 5,487,536 | A * | 1/1996 | McEachin | 269/21 |
| 5,626,124 | A | 5/1997 | Chen | |
| 5,662,094 | A | 9/1997 | Giacomelli | |
| 5,839,181 | A * | 11/1998 | Chu | 29/281.5 |
| 6,047,871 | A | 4/2000 | Chen | |
| 6,138,372 | A * | 10/2000 | Newman | 33/638 |
| 6,148,810 | A * | 11/2000 | Hepworth | 125/23.01 |
| 6,308,699 | B1 | 10/2001 | Schmitt | |
| 6,409,161 | B1 * | 6/2002 | Wolff et al. | 269/43 |
| 6,659,439 | B1 * | 12/2003 | Baumgartner et al. | 269/43 |

* cited by examiner

*Primary Examiner*—Lee D. Wilson
(74) *Attorney, Agent, or Firm*—Stevens & Showalter LLP

(57) ABSTRACT

A clamp suitable for masonry work can securely and simultaneously accommodate a plurality of bricks, blocks, stones or other masonry materials during cutting operations. The clamp may be readily set up at a construction site and provides for rapid and consistent measuring, marking and clamping of bricks allowing more precise cuts of multiple bricks in a single cutting action. The clamp comprises a first fence defining a first workpiece bearing surface, a second fence defining a second workpiece bearing surface positioned in a laterally spaced relation to the first fence, and optionally, a third fence defining a third workpiece bearing surface positioned in spaced relation from the first and second fences. A clamp operating device is provided to selectively clamp and release a workpiece between the first and second fences.

23 Claims, 3 Drawing Sheets

BRICK CLAMP FOR MASONRY WORK

BACKGROUND OF THE INVENTION

The present invention relates in general to clamping devices, and in particular to clamping devices for securing one or more bricks during cutting operations.

Cast cementitious blocks such as bricks and other brittle masonry stock are used extensively in construction projects due largely to the durability, versatility and economy provided thereby. Bricks typically have a uniform size and shape, and may be physically interlocked in any number of orientations allowing the bricks to be used in both structural and ornamental capacities. However, the hand laying of bricks is time consuming, labor intensive, and requires skill and experience to ensure professional, structurally sound, and aesthetically pleasing end results. One aspect of brick laying that is particularly time consuming is the cutting of bricks. For example, at corners, arches, windows, and doorways, certain bricks must be cut to accommodate the project design. Due to manufacturing tolerances in the underlying structure, variations in the brick dimensions and variations in the thickness of the mortar interleaved between successive rows of bricks, it is not always possible to determine and precut the necessary bricks before the start of a project. Accordingly, bricks must be cut to size on the construction site.

A number of approaches are available to cut bricks to their desired size. For example, a mason can score the brick, then using a special hammer, repeatably strike the brick until breakage occurs, hopefully along the score line. This approach is time consuming and takes considerable practice to be able to cleanly break bricks. Even once a mason can form a clean break, it is still a time consuming process. Moreover, a certain amount of wasted materials will be consumed because the random nature of the brittle bricks.

Masonry saws are also available for cutting bricks. A typical masonry saw consists of a rotating saw blade that is either provided on a fixed table or in a hand-held, portable format. The saw may also include a fluid supply that wets the bricks being cut and the saw blade to reduce the amount of ambient dust and cool the blade. Irrespective of the saw configuration, currently, bricks are manually cut, one at a time.

Such a process is enormously time consuming, as each brick must be individually measured, marked and cut to the desired specifications. The repetitiveness of the process may lead to inconsistently measured and cut bricks causing waste. Further, each brick is usually held in place by hand or foot while performing cutting operations. During the cuffing operation, the saw can kick away from the brick, and chips of brick and other debris may fly from the work area potentially creating a hazardous environment.

Accordingly, there is a need for a clamping device that is durable, portable, and is allows for multiple bricks to be securely held during cutting operations.

SUMMARY OF THE INVENTION

The present invention meets the above needs, which are not heretofore addressed by the art. The various embodiments of the present invention provide a clamp suitable for masonry work that can securely and simultaneously accommodate a plurality of bricks, blocks, stones or other masonry materials during cutting operations. For example, the clamp may be readily set up at a construction site and provides for rapid and consistent measuring, marking and clamping of bricks allowing more precise cuts of multiple bricks in a single cutting action.

According to an embodiment of the present invention, a plurality of bricks, such as a tong of bricks, is positioned on a platform such that individual bricks align in tandem. An operator clamps the bricks between a first and second fence such that the bricks are snuggly held in the clamp. The operator may optionally measure and mark an intended cut, such as by using a pencil, then, using a portable masonry saw, the bricks are cut to the desired size and shape. Upon completion of the cutting operation, the clamp may be released and the bricks removed for use in the construction project.

According to another embodiment of the present invention, a clamp suitable for masonry work comprises a first fence defining a first workpiece bearing surface, a second fence defining a second workpiece bearing surface positioned in a laterally spaced relation to the first fence, and a clamp operating device coupled to the first and second fences. The clamp operating device is operable to transition at least one of the first and second fences between a released position and a clamp engaged position. The released position is defined by a first lateral spacing between the first and second fences sufficient to insert a workpiece therebetween. The clamp engaged position is defined by a second lateral spacing between the first and second fences less than the first lateral spacing adapted such when the workpiece is inserted between the first and second fences, both the first and second workpiece bearing surfaces contact the workpiece.

The clamp further comprises a third fence defining a third workpiece bearing surface positioned in spaced relation from the first and second fences. The third fence is generally oriented such that when the clamp operating device is in the clamp engaged position and the workpiece is positioned between the first and second fences, the third workpiece bearing surface contacts the workpiece.

According to another embodiment of the present invention, a clamp suitable for masonry work comprises a work surface adapted to support a plurality of bricks, a first fence comprising a generally elongate member defining a first workpiece bearing surface, a second fence comprising a generally elongate member defining a second workpiece bearing surface and a clamp operating device operatively coupled to the first and second fences. The second workpiece bearing surface is oriented in facing relationship with, and generally parallel to, the first workpiece bearing surface. Further, the clamp operating device is operable to transition at least one of the first and second fences between a released position and a clamp engaged position where the clamp engaged position is adapted such that when the plurality of bricks are positioned in a row on the work surface, both the first and second workpiece bearing surfaces contact each of the plurality of bricks.

According to yet another embodiment of the present invention, a clamp suitable for masonry work comprises a first fence defining a first workpiece bearing surface and a second fence defining a second workpiece bearing surface. The second workpiece bearing surface is oriented in facing relationship with, and generally parallel to, the first workpiece bearing surface. The clamp also includes a measurement device selectively positionable over a work surface between the first and second fences so as to allow a user to provide at least one of a measurement and a marking on a workpiece clamped between the first and second workpiece bearing surfaces. A clamp operating device is operatively coupled to the first and second fences, and is operable to transition at least one of the first and second fences between a released position and a clamp engaged position. The clamp engaged position is adapted such that both the first and second workpiece bearing surfaces contact a workpiece.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that logical and mechanical changes may be made without departing from the spirit and scope of the present invention.

Figure 1:
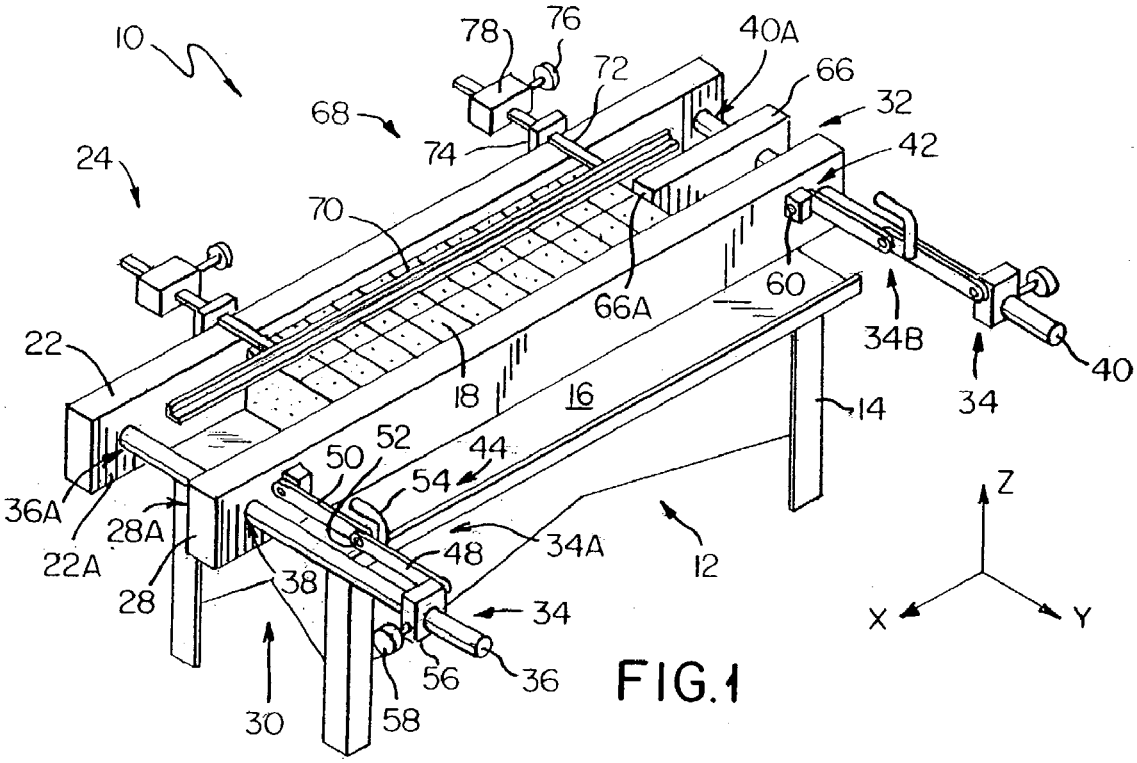
FIG. 1 is an orthogonal view of a brick clamp according to an embodiment of the present invention.
Figure 4:
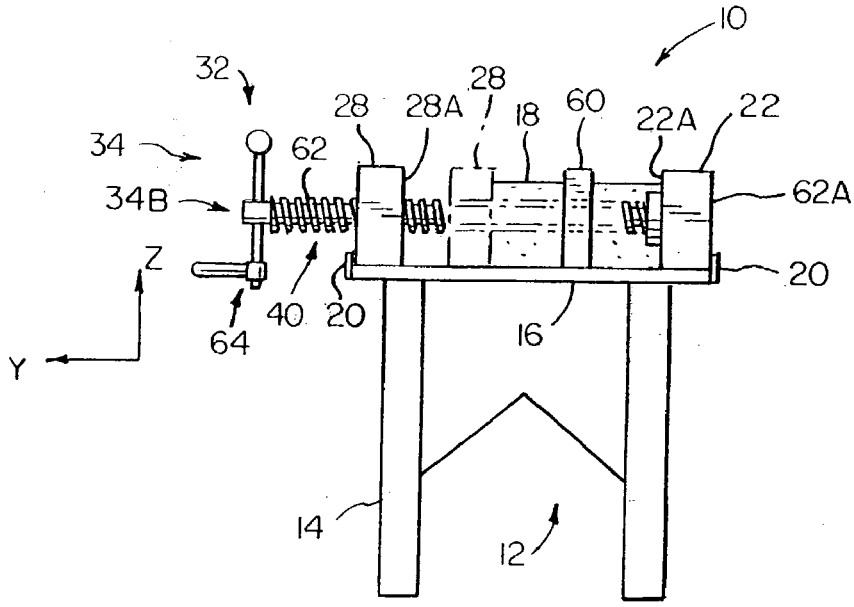
FIG. 4 is a side view of a brick clamp according to another embodiment of the present invention.
Figure 3:
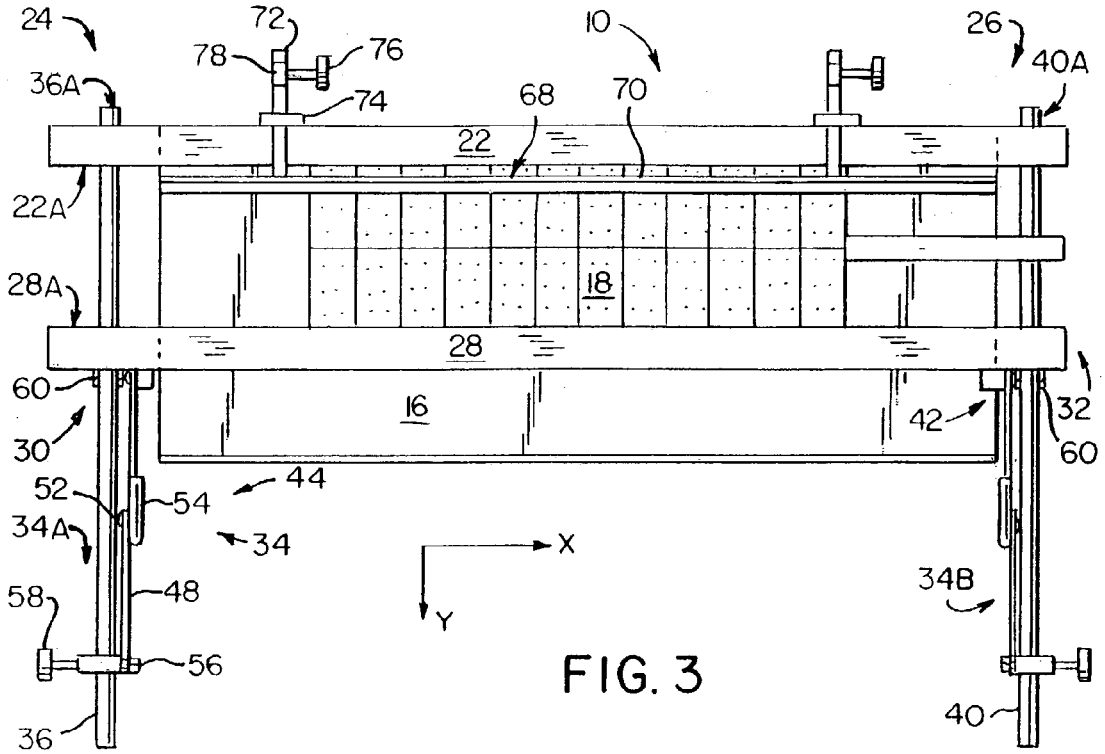
FIG. 3 is a top view of the brick clamp shown in FIG. 1.
Figure 2:
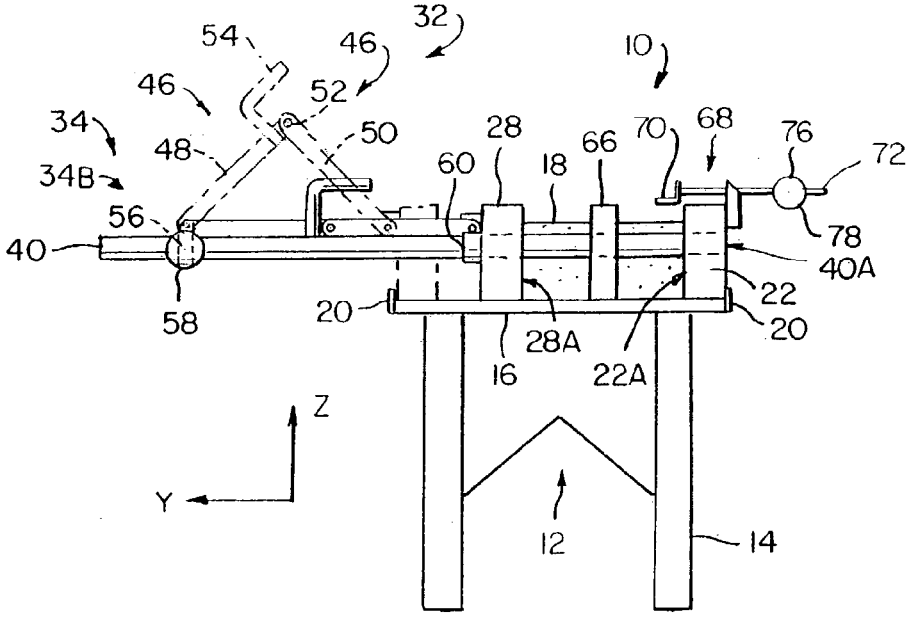
FIG. 2 is a side view of the brick clamp shown in FIG. 1 in a released position.
Figure 5:
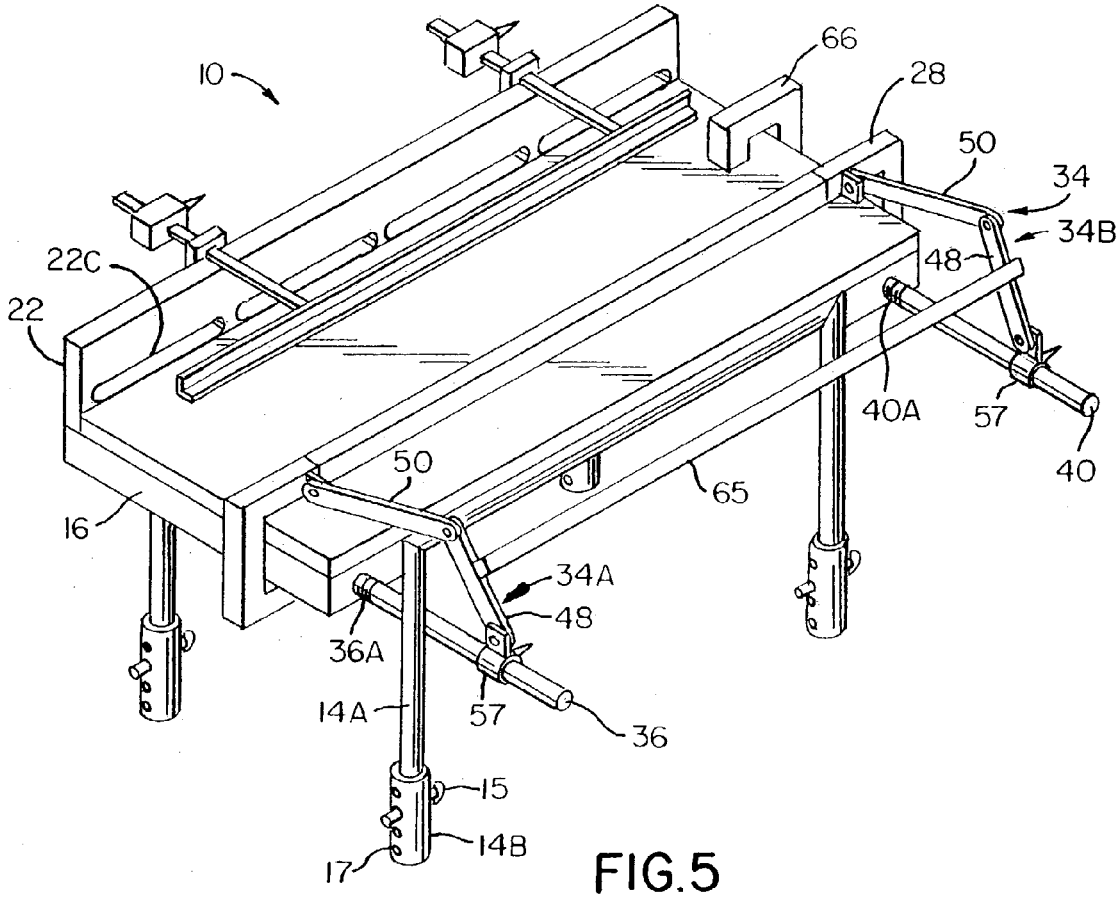
FIG. 5 is an orthogonal view of a brick clamp according to yet another embodiment of the present invention.

Referring to FIGS. 1–3, a brick clamp 10 according to an embodiment of the present invention is illustrated. As best shown in FIGS. 1 and 2, the brick clamp 10 is seated on a base unit 12 that includes base supports 14 and a generally horizontal platform 16 defining a work surface for supporting a workpiece 18. As shown in FIGS. 1 and 3, the platform 16 is generally rectangular and extends in a longitudinal direction X and a lateral direction Y. Typically, the platform 16 is level and the longitudinal and lateral directions are defined along a generally horizontal plane. However, other configurations are possible. Also, the height of the platform 16 may be determined by fixed height base supports 14, an example of which is shown in FIGS. 1–4. Alternatively, the base unit 12 may include adjustable base supports 14, an example of which is illustrated in FIG. 5. As shown in FIG. 5, the platform 16 is supported by base supports 14A, 14B that are adjustable by a relocating pin 15 in one of a plurality of predrilled holes 17 therein.

The brick clamp 10 may be fixedly attached to of detachably supported by the base unit 12. For example, the brick clamp 10 may simply rest on the base unit 12. Referring to FIG. 2, the base unit 12 may optionally include one or more supports 20 provided along the longitudinal edges of the platform 16. The supports 20 provide a barrier that prevents the clamp from disengaging from the platform 16 while the brick clamp 10 rests on the platform 16. The ready separation of the brick clamp 10 from the base unit 12 may be preferably for example, to promote portability and to facilitate easy transportation of the brick clamp 10 around a construction site. Any number of alternative approaches may be taken to temporarily secure the brick clamp 10 to the base unit 12. Moreover, although the Figures show various embodiments of the brick clamp 10 on a base unit, it shall be understood that a particular base unit is not required to practice the invention. A user may construct a suitable support for the clamp, such as using a plywood platform 16 or other material readily available at the construction site. Also, during use of the brick clamp 10, a cutting blade of a saw used to cut the workpiece 18 will cut into the platform 16. As such, the platform 16 may comprise one or more layers that are replaceable.

As used herein, a workpiece 18 is any material to be clamped by the present invention. The workpiece 18 will typically comprise one or more bricks or other masonry stock. Other materials such as masonry blocks, architectural blocks, stones and pavers may also be clamped by the present invention. As shown, the workpiece 18 comprises a plurality of bricks positioned on the platform 16 arranged in tandem defining a single row of bricks. The number of bricks that may be clamped in single operation will vary based upon the intended application and the total number of bricks that must be cut to meet the requirements of a specific project. While certainly not required, the platform 16 according to an embodiment of the present invention is sufficiently long in the longitudinal direction to accommodate a tong of bricks.

Referring to FIGS. 1–3, the brick clamp 10 comprises a first fence 22 positioned over the platform 16. The first fence 22 is a generally elongate member that includes a first workpiece bearing surface 22A extending in the longitudinal direction X, a first longitudinal end 24 and a second longitudinal end 26. A second fence 28 is positioned generally in a laterally spaced relation to the first fence 22. The second fence 28 is a generally elongate member that includes a second workpiece bearing surface 28A that extends in the longitudinal direction X, a first longitudinal end 30 and a second longitudinal end 32. As shown in the Figures, the second workpiece bearing surface 28A is oriented in facing relationship with, and generally parallel to, the first workpiece bearing surface 22A. The first and second workpiece bearing surfaces 22A, 28A may be formed integral with, or detachably mounted to the respective first and second fences 22, 28. For example, according to an embodiment of the present invention, a plate, such as an ⅛ inch (0.32 centimeters) wood piece may be used to contact the bricks loaded on the platform 16.

Referring to FIG. 5, an alternative arrangement for the first and second fences 22, 28 is illustrated. As shown, the first fence 22 is fixedly secured to the platform 16. The first fence 22 includes a plurality of slots 22C therein which allow scrap and debris to fall out or otherwise be removed from the platform 16 during use. The second fence 28 can include slots for the removal of debris, or alternatively, the second fence 28 can be oriented so as to maintained in a poised position over the platform. For example, as shown in FIG. 5, the second fence 28 is maintained approximately 1 inch (2.54 centimeters) over the platform. Under this arrangement, the second fence 28 can pass over scraps, debris and other waste on the platform 16.

A clamp operating device 34 is operable to transition at least one of the first and second fences 22, 28 between a released position and a clamp engaged position. For example, referring generally to FIGS. 1 and 3, according to an embodiment of the present invention, the clamp operating device 34 comprises a first clamp operating device 34A coupled to the first and second fences 22, 28, proximate the respective first longitudinal ends 24, 30. As shown, the first clamp operating device 34A is spaced longitudinally beyond the surface of the platform 16. A second clamp operating device 34B is coupled to the first and second fences 22, 28, proximate to the respective second longitudinal ends 26, 32. As shown, the second clamp operating device 34B is also spaced longitudinally beyond the surface of the platform 16. While such an arrangement is certainly not necessary to practice the invention, it does position the first and second clamp operating devices 34A, 34B out of the work area of the platform 16 between the first and second fences 22, 28 and provides relatively easy access to the platform 16 for loading and unloading bricks thereon.

According to an embodiment of the present invention, the first fence 22 generally maintains a fixed lateral positioned relative to the platform 16. The second fence 28 is adapted to traverse laterally towards and away from the first fence 22. As such, the first fence 22 is also referred to herein as the fixed fence 22 and the second fence 28 is referred to as the moveable fence. The clamp operating device 34 is provided to selectively traverse the second fence 28 in the lateral direction between a released position and a clamp engaged position. The released position is defined by a first lateral spacing between the first and second fences 22, 28 sufficient to insert a workpiece 18 therebetween. The clamp engaged position is defined by a second lateral spacing between the first and second fences 22, 28 less than the first lateral spacing adapted such when the workpiece 18 is inserted between the first and second fences 22, 28, both the first and second workpiece bearing surfaces 22A, 28A contact the workpiece 18 and hold the workpiece 18 securely during cutting operations.

For example, as shown, the workpiece 18 comprises a plurality of bricks. In the released position shown in FIG. 2 with dashed lines, the second fence 28 is transitioned laterally away from the first fence 22 sufficient to release the clamping hold of the first and second fences 22, 28 on the workpiece 18. The platform 16 is open and accessible for loading and unloading the workpiece 18 thereon. Preferably, the released position further allows sufficient distance between the first and second fences 22, 28 that the workpiece may be easily and readily picked up and removed from the platform 16 using customary masonry tools such as tongs. When the brick clamp 10 is in the clamp engaged position, the second fence 28 is transitioned laterally towards the first fence 22 such that the first and second workpiece bearing surfaces 22A, 28A engage the workpiece 18 as is best illustrated in FIGS. 1 and 3.

The clamp operating device 34 may take on any number of forms with the present invention so long as the clamp operating device 34 is operative against the first and second fences 22, 28 to provide a clamping action. As best shown in FIG. 1, according to an embodiment of the present invention, a first guide bar 36 passes between the first and second fences 22, 28. For example, the first guide bar 36 includes a first terminal end 36A that is fixedly supported to the first fence 22 proximate to the first longitudinal end 30 thereof. By fixedly supported, it is meant that lateral movement of the first fence relative to the first guide bar is generally prevented. The first guide bar 36 projects in a lateral direction towards the second fence 28 and passes through a first aperture 38 in the second fence 28 proximate to the first longitudinal end thereof. The first aperture 38 is dimensioned to allow the second fence 28 to reciprocate generally freely in the lateral direction with respect to the first guide bar 36, and may optionally include bearings or other friction reducing mechanisms.

Similarly, a second guide bar 40 includes a first terminal end 40A that is fixedly secured to the first fence 22 proximate to the second longitudinal end 26 thereof. The second guide bar 40 passes through a second aperture 42 in the second fence 28 proximate to the second longitudinal end 32 thereof. The second aperture 42 is dimensioned to allow the second fence 28 to reciprocate generally freely in the lateral direction with respect to the second guide bar 40, and may optionally include bearings or other friction reducing mechanisms.

A first clamp actuation control 44 couples between the second fence 28 and the first guide bar 36, and a second clamp actuation control 46 couples between the second fence 28 and the second guide bar 40. The first and second clamp actuation controls 44, 46 are selectively operated to transition the first and second fences 22, 28 between the released and clamp engaged positions by selectively traversing the second fence 28 along the first and second guide bars 36, 40.

An exemplary arrangement for the first and second clamp actuation controls 44, 46 is shown in FIGS. 1–3. Each of the first and second actuation controls 44, 46 includes a first linkage 48 that is coupled to each guide bar 36, 40 distal to the second fence 28. A second linkage 50 is pivotally coupled to the second fence 28, and the first and second linkages 48, 50 are hingedly coupled together by a hinge connection 52. The hinge connection 52 can be a pin, screw or any other device that allows the first and second linkages to be hingedly connected. An actuation lever or handle 54 is provided on one of the first and second linkage 48, 50 to allow manual lateral movement of the second fence 28 towards and away from the fixed first fence 22 to position the brick clamp 10 between the released and clamp engaged positions. As such, each handle is 54 hingedly supported between a respective guide bar 36, 40 and the second fence 28.

The relative lengths of the first and second linkages 48, 50, the lateral positioning of the first linkage 48 along a respective guide bar 36, 40, and the degree to which the first and second linkages 48, 50 are free to pivot can be adjusted to determine a suitable distance between the first and second fences 22, 28. Moreover, the first and second clamp actuation controls 44, 46 may be provided with a suitable locking device when the brick clamp 10 is in the clamp engaged position. For example, referring to FIG. 2, when the brick clamp 10 is in the clamp engaged position, the first and second linkages 48, 50 are oriented in a sufficiently linear relationship that the first and second linkages 48, 50 effectively lock the second fence 28 in position until an angular and upward force is applied to the handle 54 to pivot the hinge connection 52 sufficiently to unlock the clamp actuation controls 44, 46.

The above described toggle clamp arrangement typically provides a fast and positive clamping action. However, the clamping force is typically predetermined when toggled to the clamp engaged position. Referring to FIGS. 1–3 generally, to accommodate for the variations in workpiece size, according to an embodiment of the present invention, the first linkage 48 is continuously repositionable along the guide bar 36, 40. The first linkage 48 is pivotally/hingedly mounted to the guide bar 36, 40 by a first collar 56. The collar is slipped over the guide bar and may be tightened down, such as by thumb screws 58 so as to prevent lateral motion of the first collar 56 with respect to the associated guide bar. To facilitate coupling of the second linkage 50 to the second fence, a second collar 60 may be used. The second collar hingedly supports the second linkage 50 and provides a connection to the second fence 28.

The adjustability of the first linkage 48 along the guide bar 36, 40 and the optional adjustability of the hinge connection 52 provides the ability to adjust the lateral distance from the second fence 28 to the first fence 22 when the clamp actuation controls 44, 46 are transitioned to the clamp engaged and released positions. Further, the speed of operation typically associated with toggle action clamps is enhanced by the ability to accommodate irregular brick size. The first and second clamp actuation controls 44, 46 are optionally independently adjustable and operable. As such, the first clamp actuation control 44 is operatively configured to selectively reciprocate a first longitudinal end of the second fence 28 between the released and clamp engaged positions, and the second clamp actuation control 46 is operatively configured to selectively reciprocate a second longitudinal end of the second fence 28 between the released and clamp engaged positions.

According to another embodiment of the present invention, instead of using a toggle-action clamping arrangement, a screw clamp arrangement is implemented. Screw clamps can tolerate irregularities in brick size because the amount of clamping force applied by the clamp will be determined by the amount of turns applied to a screw clamp handle. Thus the screw clamp provides positive clamping with a variably adjustable clamping force. Referring to FIG. 4, at least one guide bar 62 is threadably received by the second fence 28 and includes a first terminal end 62A fixedly secured to the first fence 22. The second fence 28 is threadably received by the guide bar 62 such that rotation of the guide bar 62 in a first direction causes unitary lateral motion of the second fence 28 towards the first fence 22, and rotation of the guide bar 62 in a second direction causes unitary lateral motion of the second fence 28 away from the first fence 22. The guide bar 62 may be implemented for example, as a worm gear. A hand wheel 64 is provided at the laterally forward end of each guide bar 62 to selectively advance and retract the second fence 28.

Referring to FIG. 5, the brick clamp 10 according to another embodiment of the present invention includes guide bars 36, 40 that pass under the top surface of platform 16. As such, the guide bars 36, 40 will not interfere with the work area. The guide bars 36, 40 may pass under the platform 16, or may alternatively pass through the platform 16. The first linkage 48 couples to the guide bars 36, 40 by squeeze clamps 57. The squeeze clamps 57 may include a collar that grips the respective guide bar 36, 40, and a hand lever that allows the lateral position of the squeeze clamp 57 with respect to the guide bar 36, 40 to be adjusted. For example, according to one embodiment of the present invention, the guide bars 36, 40 include threaded portions that allow them to thread into the side of the platform 16. The guide bars 36, 40 may optionally pass through or under the platform 16 and through the second fence 28 so that the second fence 28 slides thereon. The guide bars 36, 40 terminate at the platform 16 proximate to the first fence 22.

The threaded portions of the guide bars 36, 40 also provide a convenient approach to disassembling the brick clamp 10 for compact storage or transportation. In that regard, the base unit 12 may include a convenient place, such as under the platform 16 to store the guide rods 36, 40 when the brick clamp 10 is not in use. This approach also allows the guide bars 36, 40 replaced with bars of different dimensions, such as to accommodate bricks of varying sizes. Also, as illustrated, the second fence 28 includes generally "C" shaped ends that wrap about the platform 16. A longitudinal handle 65 couples the first and second clamp operating devices 34A, 34B. The longitudinal handle 65 allows single handed operation of both of the first and second clamp operating devices 34A, 34B generally concomitantly.

Other clamping arrangements may also be used with the present invention, including for example, different toggle clamp arrangements, cam action clamps, hold down or latch clamps, spindle clamps, squeeze clamps, screw clamp or other clamping structures so long as the first and second fences 22, 28 can selectively be transitioned between the released and clamp engaged positions.

Referring to FIGS. 1–4 generally, the brick clamp 10 further includes a third fence 66 in spaced relation from the first and second fences 22, 28 that includes a third workpiece bearing surface 66A. The third fence 66 comprises a pivotably adjustable longitudinal abutment surface positioned generally between the first and second fences 22, 28 such that the third bearing surface 66A is generally orthogonal to the first and second bearing surfaces 22A, 28A. The third fence 66 is adapted to limit longitudinal advancement of the workpiece 18 during workpiece loading operations and assists in the alignment of workpiece 18 loaded in the brick clamp 10. The third workpiece bearing surface 66A further holds the workpiece 18 from kicking out of the brick clamp 10 by the forces of the saw, such as the rotation of the saw blade, during cutting operations.

The third fence 66 can be pivotably rotated in a vertical dimension, for example, about the guide bar 40. The pivotal nature of the third fence 66 allows the third fence 66 to be rotated off the platform 16, or at least out of the way of the work surface while loading the workpiece 18 onto the platform 18. The workpiece 18 is generally positioned between the first and second fences 22, 28, and the third fence 66 is rotated into an operative position such that the third workpiece bearing surface 66A is suitable aligned towards the workpiece 18. The workpiece 18 may then be aligned by urging the workpiece 18 longitudinally towards the third fence 66 until the forward most portion of the workpiece 18, typically the forward most brick, contacts the third workpiece bearing surface 66A. Accordingly, when a workpiece 18 such as a plurality of bricks are held in the brick clamp 10, the bricks are supported by at least three workpiece bearing surfaces 22A, 28A, 66A.

The third fence 66 is preferably laterally adjustably supported generally between the first and second fences 22, 28. For example, the third bearing surface 66A may align in a position that would otherwise make it difficult to perform a satisfactory cut on the forward most brick loaded in the brick clamp 10. By allowing the third fence 66 to be selectively repositionable laterally between the first and second fences 22, 28, the third fence 66 can be satisfactorily moved out of the way of the particular cutting operation. As such, the third workpiece bearing surface 66A is preferably relatively small in the lateral dimension to allow for suitable flexibility in repositioning the third fence 66.

Referring to FIG. 5, the third fence 66 may also be arranged to slide laterally along the second guide bar 40. For example, as shown, the third fence 66 is generally "C" shaped and is coupled about the outer edge of the platform 16. A user either manually or otherwise adjusts the position of the third fence 66 in the lateral direction to selectively positioned the third fence 66 for workpiece cutting operations.

The brick clamp 10 further includes a measure 68 mounted proximate to the first fence 22. The measure 68 includes a memory so that a given measurement may be repeated for several cutting operations. The measure 68 is slidably adjustable to reposition the measure 68 onto the workpiece for measurement and marking thereon, and may be selectively positioned out of the way of the platform 16. For example, referring to FIG. 2, the measure 68 is shown positioned over the first fence 22 and is generally out of the way of the platform 16 and is clear of the area where a user would perform a cut on the workpiece 18. Referring to FIG. 1, prior to cutting the workpiece 18, the workpiece such as a plurality of bricks is loaded onto the platform 16. The measure 68 is then slid over the bricks for measurement and/or marking of the cut to be performed. The bricks are scribed by scoring a mark on the bricks along the edge of the measure, and the measure is repositioned laterally towards the first clamping member 22 out of the way of the saw.

For example, the measure 68 provides an elongate, laterally extending straight edge 70. The straight edge 70 may optionally be marked with any indicia including measurement markings or other indications. A pair of shafts 72 couple the straight edge 70 to an associated block 74 mounted behind or around the first fence 22. A threaded handle 76 clamps a measurement collar 78 to an associated shaft 72 behind the block 74. This arrangement provides a memory function by defining a stop that limits the lateral extension of the measure 70 towards the second fence 28. Once the threaded screw handle 76 locks the measurement collar 78, a user simply pulls the measure 70 laterally towards the second fence 28 until the measurement collar 78 engages the block 74. Once fully extended, a cut line or other markings may be applied to the workpiece 18.

In use, the clamp operating device 34 is operated to place the brick clamp 10 in the released position if the clamp is not already therein. A plurality of bricks, such as a tong of bricks, is positioned on the platform 16. The bricks are oriented in tandem in a single row such that adjacent bricks abut in contact with one another, and are suitably positioned between the first and second fences 22, 28. The third fence 66 is pivoted and laterally adjusted until the third workpiece bearing surface 66A is oriented towards the bricks. The bricks are urged longitudinally towards the third fence 66 until the forward most brick engages the third workpiece bearing surface 66A. The clamp operating device 34 is operated to advance the second fence 28 from the released position to the clamp engaged position so as to provide a clamping action to hold the bricks from movement during cutting operations. A user slides the measure 70 over the bricks and scores a suitable cut line. The measure is returned to a position out of the work area, and a saw equipped with a suitable blade is used to cut the bricks along the score line. Once the cut is complete, the brick clamp 10 is transitioned to the clamp released position and the third fence 66 is optionally pivoted away from the work surface. A user may remove the plurality of cut bricks from the platform 16, such as by grabbing the tandem line of cut bricks with tongs.

Having described the invention in detail and by reference to preferred embodiments thereof, it will be apparent that modifications and variations are possible without departing from the scope of the invention defined in the appended claims.

What is claimed is:

1. A clamp suitable for masonry work comprising:

a first fence including a first workpiece bearing surface;

a second fence including a second workpiece bearing surface positioned in a laterally spaced relation to said first fence;

a clamp operating device operable to transition at least one of said first and second fences between a released position and a clamp engaged position wherein;

said released position is defined by a first lateral spacing between said first and second fences sufficient to insert a workpiece therebetween; and said clamp engaged position is defined by a second lateral spacing between said first and second fences such that when said workpiece is inserted between said first and second fences and said clamp operating device is in said clamp engaged position, said workpiece is clamped by said first and second workpiece bearing surfaces;

a third fence including a third workpiece bearing surface movable laterally between said first and second workpiece bearing surfaces such that when said clamp operating device is in said clamp engaged position and said workpiece is positioned between said first and second fences, said third workpiece bearing surface contacts said workpiece; and a measuring device mounted proximate to a select one of said first and second fences, said measuring device selectively repositionable over said workpiece and adapted to allow at least one of a measurement and a marking of a cut line of said workpiece.

2. The clamp according to claim 1, wherein:

said first workpiece bearing surface extends in a longitudinal direction and faces in a lateral direction;

said second workpiece bearing surface extends in said longitudinal direction and faces in said lateral direction, said second workpiece bearing surface generally facing toward said first workpiece bearing surface when said clamp operating device is in said clamp engaged position; and said third workpiece bearing surface faces generally in said longitudinal direction when said clamp operating device is in said clamp engaged position.

3. The clamp according to claim 1, wherein said third fence is movably supported generally between said first and second fences and transitionable such that said third workpiece bearing surface can be brought to selectively engage and disengage said workpiece when said workpiece is positioned between said first and second fences.

4. The clamp according to claim 1, wherein said third fence is pivotably supported generally between said first and second fences.

5. The clamp according to claim 1, wherein said clamp operating device comprises:

a guide bar that passes between said first and second fences; and a clamp actuation control operative to transition said clamp operating device between said released and clamp engaged positions.

6. The clamp according to claim 5, wherein;

said guide bar has a first terminal end fixedly supported by said first fence and said second fence is adapted to reciprocate generally axially along said guide bar, and said clamp actuation control comprises a handle supported between said guide bar and said second fence.

7. The clamp according to claim 1, wherein:

said first fence has first and second longitudinal ends;

said second fence has first and second longitudinal ends;

said first and second fences are oriented such that said first and second workpiece bearing surfaces are positioned in generally facing relationship; and said clamp operating device comprises:

a first guide bar having a first terminal end fixedly supported with respect to said first fence and adapted to allow said second fence to reciprocate with respect thereto, said first guide bar positioned generally proximate to said first longitudinal end of said first and second fences;

a second guide bar having a first terminal end fixedly supported with resect to said first fence and adapted to allow said second fence to reciprocate with respect thereto, said second guide bar positioned generally proximate to said second longitudinal end of said first and second fences;

a first clamp actuation control operatively configured to selectively reciprocate said second fence between said released and clamp engaged positions;

a second clamp actuation control operatively configured to selectively reciprocate said second fence between said released and clamp engaged positions.

8. The clamp according to claim 7, wherein said first clamp actuation control couples between said second fence and said first guide bar, and said second clamp actuation control hingedly couples between said second fence and said second guide bar.

9. The clamp according to claim 8, wherein said first and second clamp actuation controls are adjustable such that a lateral spacing between said first and second fences can be adjusted when said clamp operating device is in said clamp engaged position.

10. The clamp according to claim 8, wherein said first and second clamp actuation controls are adjustable such that a lateral spacing between said first and second fences can be adjusted when said clamp operating device is in said released position.

11. The clamp according to claim 8, further comprising a single handle arranged so as to transition said first and second clamp actuation on controls generally concomitantly.

12. The clamp according to claim 1, wherein said measuring device comprises an adjustable straight.

13. The clamp according to claim 1, wherein said clamp operating device comprises at least one guide bar threadably received by said second fence and having a first terminal end fixedly supported by said first fence such that rotation of said at least one guide bar in a first direction causes unitary lateral motion of said second fence towards said first fence, and rotation of said at least one guide bar in a second direction causes unitary lateral motion of said second fence away from said first fence.

14. The clamp according to claim 1, wherein at least one of said first and second fences comprises at least one slot therein adapted to allow debris from cutting said workpiece to pass therethrough.

15. The clamp according to claim 1, wherein at least one of said first and second workpiece bearing surfaces is detachably mounted to its associated one of said first and second fences.

16. The clamp according to claim 1, wherein said second workpiece bearing surface is laterally movable over and spaced from a work surface sufficient to allow said second workpiece bearing surface to pass over debris on said work surface.

17. The clamp according to claim 1, wherein said measuring device further comprises a memory such that a user defined measurement can be repeated for several clamping operations.

18. A clamp suitable for masonry work comprising:

a first fence comprising first workpiece bearing surface;

a second fence comprising a second workpiece bearing surface arranged such that;

said second workpiece bearing surface is laterally movable over a platform and is arrant such that at least a portion of a bottom edge of said second workpiece bearing surface is spaced from said platform sufficient to allow said second workpiece bearing surface to pass over debris that may form on said platform during cutting operations; and said second workpiece bearing surface is oriented in facing relationship with said first workpiece bearing surface;

a third fence proximate to an end of said first and second fences arranged such that:

said third fence includes a third workpiece bearing surface that is laterally movable between said first and second workpiece bearing surfaces; and a clamp operating device operatively coupled to said first and second fences, said clamp operating device operable to transition at least one of said first and second fences between a clamp released position and said clamp engaged position wherein, said masonry workpiece is clamped by said first, second and third workpiece bearing surfaces when said clamp is in said clamp engaged position.

19. The clamp according to claim 18, further comprising a measuring device mounted proximate to a select one of said first and second fences, said measuring device selectively repositionable over said workpiece and is adapted to allow at least one of a measurement and a marking of a cut line on said workpiece.

20. A clamp suitable for masonry work comprising:

a first fence including a first workpiece bearing surface;

a second fence including a second workpiece bearing surface, said second workpiece bearing surface oriented in facing relationship with, and generally parallel to, said first workpiece bearing surface;

a measurement device mounted proximate to a select one of said first and second fences, said measurement device selectively repositionable over a workpiece supported on a work surface between said first and second fences so as to allow a user to provide at least one of a measurement and a marking of a cut line of on aid workpiece clamped between said first and second workpiece bearing surfaces;

a clamp operating device operatively coupled to said first and second fences, said clamp operating device operable to transition at least one of said first and second fences between a released position and a clamp engaged position, said clamp engaged position adapted such that both said first and second workpiece bearing surfaces clamp a workpiece.

21. The clamp according to claim 20, further comprising a third fence including a third workpiece bearing surface movable laterally between said first and second workpiece bearing surfaces.

22. The clamp according to claim 21, wherein said third fence is pivotably in a vertical dimension and repositionable laterally.

23. The clamp according to claim 20, wherein at least one of said first and second workpiece bearing surfaces is detachably mounted to its associated one of said first and second fences.

* * * * *

UNITED STATES PATENT AND TRADEMARK OFFICE

CERTIFICATE OF CORRECTION

PATENT NO. : 7,011,085 B1
APPLICATION NO. : 10/438564
DATED : March 14, 2006
INVENTOR(S) : Matthew Lochotzki It is certified that error appears in the above-identified patent and that said Letters Patent is hereby corrected as shown below:

In the Specification:

Col. 3, line 54, “attached to of detachably supported” should read --attached to or detachably supported--;

Col. 4, line 52, “oriented so as to maintained” should read --oriented so as to be maintained--;

Col. 5, line 60, “longitudinal end thereof” should read --longitudinal end 30 thereof--;

Col. 6, line 31, “each handle is 54 hingedly supported” should read --each handle 54 is hingedly supported--;

Col. 8, line 28, “workpiece 18 on platform 18” should read --workpiece 18 on the platform 16--;

In the claims:

Col. 10, line 52, “guide bar, and” should read --guide bar; and--;

Col. 11, line 2, “with resect to said” should read --with respect to said--;

Col. 11, line 16, “clamp actuation control hingedly couples” should read --clamp actuation control couples--;

Col. 11, line 30, “clamp actuation on controls generally” should read --clamp actuation controls generally--;

Col. 11, line 32, “an adjustable straight.” should read --an adjustable straight edge.--;

Col. 11, line 64, “and is arrant such that” should read --and is arranged such that--;

Col. 12, line 39, “cut line of on said” should read --cut line on said--;

UNITED STATES PATENT AND TRADEMARK OFFICE

CERTIFICATE OF CORRECTION

PATENT NO. : 7,011,085 B1
APPLICATION NO. : 10/438564
DATED : March 14, 2006
INVENTOR(S) : Matthew Lochotzki It is certified that error appears in the above-identified patent and that said Letters Patent is hereby corrected as shown below:

In the claims (cont'd):

Col. 12, lines 39-40, "aid workpiece clamped" should read --said workpiece clamped--;

Col. 12, line 54, "fence is pivotably in a vertical dimension" should read --fence is pivotable in a vertical dimension--.

Signed and Sealed this

Seventeenth Day of October, 2006

JON W. DUDAS
*Director of the United States Patent and Trademark Office*